United States Patent [19]

Baumert et al.

[11] Patent Number: 4,511,453

[45] Date of Patent: Apr. 16, 1985

[54] CORROSION INHIBITION WHEN DISTILLING COAL LIQUIDS BY ADDING CRESOLS OR PHENOLS

[75] Inventors: Kenneth L. Baumert, Emmaus, Pa.; Alberto A. Sagues, Lexington; Burtron H. Davis, Georgetown, both of Ky.

[73] Assignee: International Coal Refining Company, Allentown, Pa.

[21] Appl. No.: 591,737

[22] Filed: Mar. 21, 1984

[51] Int. Cl.[3] ..... C10G 1/04; C10G 7/10

[52] U.S. Cl. ..... 208/8 LE; 208/47; 208/348

[58] Field of Search ..... 208/47, 8 LE, 348, 10; 203/7

[56] References Cited

U.S. PATENT DOCUMENTS

| | | | |
|---|---|---|---|
| 2,408,011 | 9/1946 | Walsh, Jr. et al. | 208/348 |
| 3,247,094 | 4/1966 | Dajani et al. | 208/47 |
| 3,294,705 | 12/1966 | Kautsky | 208/47 |
| 3,328,285 | 6/1967 | Godar | 208/47 |
| 3,437,583 | 4/1969 | Gonzalez | 203/7 |
| 3,553;101 | 1/1971 | Foroulis | 203/7 |
| 3,649,167 | 3/1972 | Sawyer | 203/7 |
| 3,676,327 | 7/1972 | Foroulis | 203/7 |
| 3,779,903 | 12/1973 | Stedman | 203/7 |
| 4,200,518 | 4/1980 | Mulvany | 208/348 |
| 4,388,172 | 6/1983 | Rodewald et al. | 208/47 |
| 4,472,263 | 9/1984 | Garg et al. | 208/8 LE |

FOREIGN PATENT DOCUMENTS

| | | | |
|---|---|---|---|
| 0431519 | 7/1935 | United Kingdom | 208/47 |

OTHER PUBLICATIONS

Hendrickson, *Synthetic Fuels Data Handbook,* 1975, by Cameron Engineers, Inc., Denver, Colo. p. 144.

*Primary Examiner*—Delbert E. Gantz
*Assistant Examiner*—Lance Johnson
*Attorney, Agent, or Firm*—Kimbley L. Muller

[57] ABSTRACT

Fractionation apparatus material corrosion in a coal liquefaction system is reduced by addition of compounds having a $pK_b < 6$ to tower feed streams or to the tower itself.

2 Claims, 1 Drawing Figure

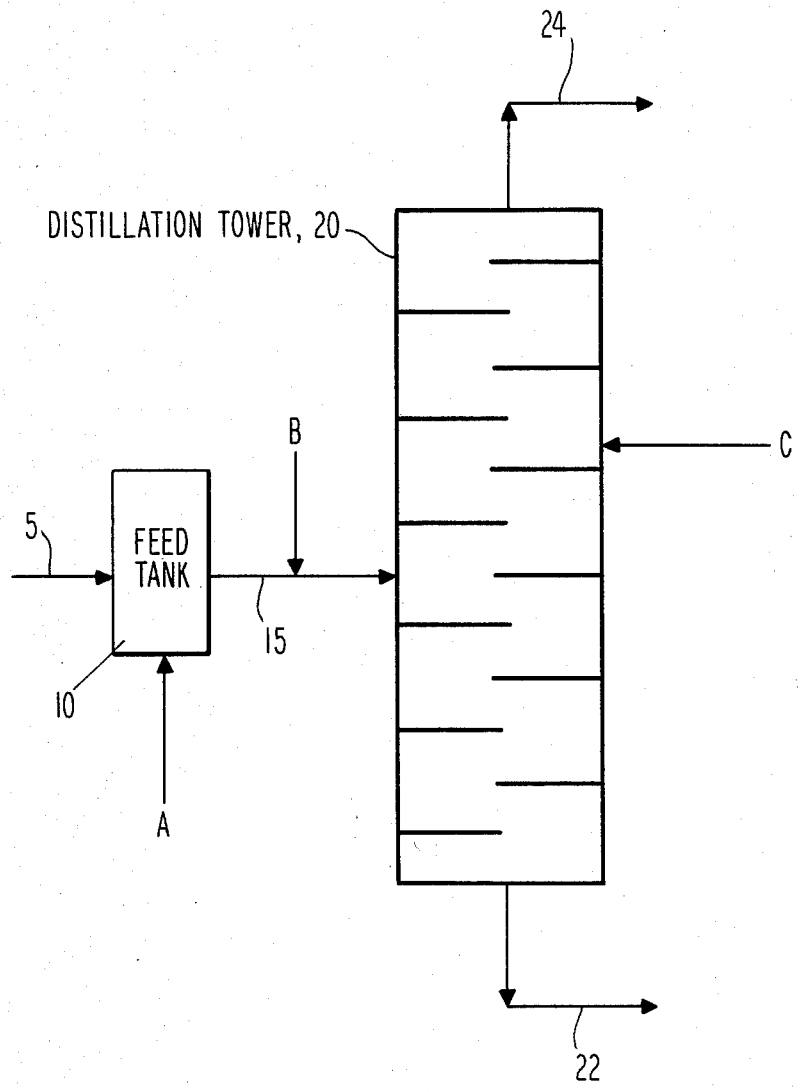
24
DISTILLATION TOWER, 20
B
C
5
FEED TANK
15
10
A
22

CORROSION INHIBITION WHEN DISTILLING COAL LIQUIDS BY ADDING CRESOLS OR PHENOLS

The Government of the United States of America has rights in this invention pursuant to Contract No. DE-AC05-780R03054 (as modified) awarded by the U.S. Department of Energy.

BACKGROUND OF THE INVENTION

A necessary step in the production of solvent refined coal (SRC) and other coal liquefaction products is a solvent fractionation or distillation step. Such fractionation is usually accomplished in a distillation tower at atmospheric or below atmospheric pressures. The liquids to be fractionated contain a number of constituent species. Nitrogen compounds, most of which can be classified as amines, constitute a significant fraction of these liquids. Oxygenated compounds of the phenol variety and chloride from the coal dissolved in the process solvent are also present. The chloride is generally associated with the nitrogen compounds, and forms the amine hydrochloride within the tower. It has been found that the chemical makeup of the coal liquids within the fractionation tower are highly corrosive. Corrosion rates on the order of 1,000 mpy (mils per year) have been reported for stainless steel tower materials. The severity of this corrosion has required the relining, retraying, or total replacement of fractionation apparatus.

It has been determined that the corrosive constituents in coal liquids are phenols, sulfur compounds, and certain water soluble chlorides. These three constituents interact synergistically to corrode iron based alloys in a reaction with an approximate ultimate stoichiometry of:

$$Fe+2HCl->FeCl_2+H_2 \quad (1)$$

Because of the stoichiometry indicated by equation (1), limitation of chloride concentrations will necessarily limit the amount of iron which can be corroded by a given amount of coal liquid. (If the reaction were catalytic rather than chemical, each chloride ion could be responsible for the dissolution of many metal atoms.)

PRIOR ART

In an effort to reduce or eliminate corrosion in coal liquid fractionation towers, several methods have been tested and/or used. Towers used in coal tar distillation have been maintained at low levels of corrosion by the injection of sodium carbonate into the tower as a solution. However, the solvent flashes and resulting sodium carbonate solid drops out near the injection point. As a result, the tower has a tendency to plug near the injection point and must be taken out of service for frequent cleaning.

Injection of sodium hydroxide to the tower has also been used. Because sodium hydroxide is a stronger base, the quantities required to prevent corrosion are lower. However, polymerization of hydrocarbons in the tower are promoted by the strength of the base and can cause plugging problems.

Sodium carbonate addition to feed coal has proven to be effective at reducing corrosion of the fractionation apparatus. However, approximately 1.5 times stoichiometric amounts are needed because of competing reactions with aluminum, silicon, and sulfur. In addition, most of the sodium ends up in the ash and is thus detrimental to the gasifier. Finally, this amount of sodium carbonate addition to the process is extremely costly.

Other techniques such as water washing the incoming stream and side stream draw off have been considered and tested in the laboratory. These techniques are either impractical due to energy considerations or present problems in dealing with the waste they create.

OBJECTIVES OF THE INVENTION

It is a primary object of the present invention to reduce substantially or eliminate corrosion in the coal liquid fractionation tower of a coal liquefaction facility.

It is yet another object of the present invention to reduce or eliminate coal liquid fractionation tower corrosion while maintaining both energy efficiency and economy.

It is yet another object of this invention to eliminate coal liquid fractionation tower corrosion while not contributing to tower plugging.

BRIEF DESCRIPTION OF THE INVENTION

The present invention uses strong basic nitrogen compounds or salts of phenols to neutralize the chloride containing feedstream to the tower. The advantages of using strong basic nitrogen compounds or salts of phenols are that: (1) stoichiometric amounts can be added to the tower since there are few if any competing reactions; (2) the solvent for these compounds can be tower liquid and hence the solvent will not flash on introduction to the tower; (3) the compounds will not plug the tower nor will they tend to polymerize tower liquids leading to plugging; (4) injection equipment will be inexpensive; (5) no waste water is generated from this process; and (6) neutralized chlorides will concentrate in a stream where they may be transferred from a hydrocarbon to a water stream.

BRIEF DESCRIPTION OF THE DRAWING

The drawing is a block diagram of the material flow of the present invention.

DETAILED DESCRIPTION OF THE INVENTION

According to the present invention strong basic compounds are added in approximately stoichiometric amounts to the coal liquids entering the fractionation tower. The addition may be carried out by adding such compounds into the feed tank (10) via line A, injecting such compounds into the feed tank to tower transfer line (15) via line B, or injecting the compound directly into the tower (20) in the 400° to 450° F. temperature range via line C.

A typical neutralization reaction using iron phenolate would be as shown in equation (2).

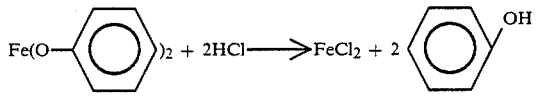

(2)

Other strong basic compounds suitable for practicing the present invention include compounds having a $pK_b<6$. Among this class are the group IA, IIA, VI, VIII, IB metal phenolates, $C_1$–$C_4$ alkyl substituted metal phenolates, $C_1$–$C_4$ alkyl substituted metal cresols, and $C_1$–$C_4$ alkyl multiply-substituted metal phenolates and cresols. Amines having a $pK_b<6$ such as dicyclohexylamine, are also suitable.

The remaining corrosion inducing components (after chloride neutralization) would of course, be phenols and sulfur compounds. These are adequately dealt with through the use of specialized alloys in tower construction. For instance, type 304 stainless steel is usually adequate to resist corrosion from high temperature phenols. (The phenol concentration of the coal liquefaction process ranges from 10 to 50 wt. % in many streams.)

Sulfur corrosion is reduced through the alloying of varying amounts of chromium within stainless steels.

We claim:

1. In a process for the solvent refining of coal which includes fractionation of coal liquids containing nefarious amine hydrochloride by atmospheric or subatmospheric distillation in a fractionation tower, the improvement which consists of adding to said coal liquids, before fractionation, a compound selected from the group consisting of phenolates of Group IA, IIA, VI, VIII and IB, $C_1$–$C_4$ alkyl substituted metal phenolates, $C_1$–$C_4$ alkyl substituted metal cresols, $C_1$–$C_4$ polyalkyl metal phenolates and $C_1$–$C_4$ poly-substituted metal cresols, said selected compound having a pKb of less than 6 to reduce corrosion within said fractionation tower.

2. In a process for the solvent refining of coal which includes fractionation of coal liquids containing nefarious amine hydrochloride by atmospheric or subatmospheric distillation in a fractionation tower, the improvement which consists of adding in the 400°–450° F. range of said fractionation tower a compound selected from the group consisting of phenolates of Group IA, IIA, VI, VIII and IB, $C_1$–$C_4$ alkyl substituted metal phenolates, $C_1$–$C_4$ alkyl substituted metal cresols, $C_1$–$C_4$ polyalkyl metal phenolates and $C_1$–$C_4$ polysubstituted metal cresols, said selected compound having a pKb of less than 6 to reduce corrosion within said fractionation tower.

* * * * *